United States Patent [19]

Grieb

[11] Patent Number: 4,940,084

[45] Date of Patent: Jul. 10, 1990

[54] HEAT EXCHANGER COMPRISED OF SECTIONS DETACHABLY AND SEALABLY CLAMPED TOGETHER AND ITS METHOD OF ASSEMBLY

[75] Inventor: Hubert Grieb, Germering, Fed. Rep. of Germany

[73] Assignee: MTU Motoren Und Turbinen- Union Munchen GmbH, Munich, Fed. Rep. of Germany

[21] Appl. No.: 303,921

[22] Filed: Jan. 30, 1989

[30] Foreign Application Priority Data

Feb. 10, 1988 [DE] Fed. Rep. of Germany ..... 3803947

[51] Int. Cl.[5] ..... F28F 9/02

[52] U.S. Cl. ..... 165/76; 165/176; 29/888.052

[58] Field of Search ..... 165/76, 144, 145, 153, 165/176; 29/152.3 R

[56] References Cited

U.S. PATENT DOCUMENTS

| | | | |
|---|---|---|---|
| 916,640 | 3/1909 | Warg | 165/176 |
| 3,605,882 | 6/1969 | Smith et al. | 165/173 |
| 4,809,774 | 3/1989 | Hagemeister | 165/163 |

FOREIGN PATENT DOCUMENTS

| | | | |
|---|---|---|---|
| 214188 | 10/1909 | Fed. Rep. of Germany | 165/101 |
| 730039 | 12/1942 | Fed. Rep. of Germany | 165/153 |
| 3635548 | 3/1988 | Fed. Rep. of Germany | 165/176 |
| 859510 | 12/1940 | France | 165/153 |
| 134277 | 10/1919 | United Kingdom | 165/153 |

*Primary Examiner*—Martin P. Schwadron
*Assistant Examiner*—Allen J. Flanigan
*Attorney, Agent, or Firm*—Ladas & Parry

[57] ABSTRACT

The air ducts of a heat exchanger are formed of a plurality of duct sections arranged axially one after the other and are clamped together in sealed relation by tension pipes arranged in spaced relation within the respective ducts sections. The tension pipes are perforated to permit air flow between the ducts and heat exchange tubes connected thereto.

12 Claims, 4 Drawing Sheets

Fig. 4a
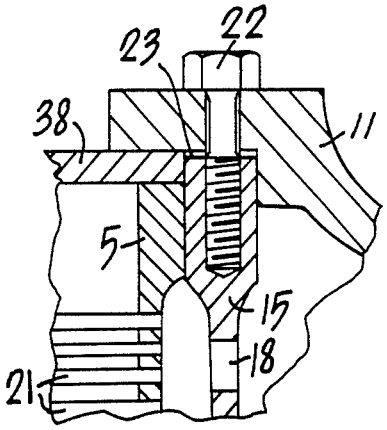
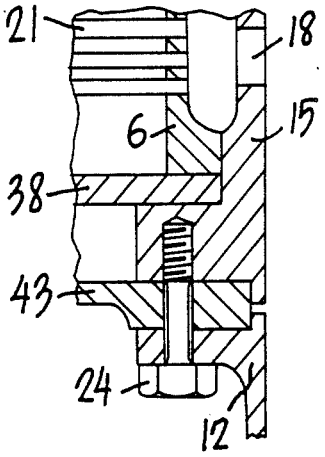
Fig. 4b

HEAT EXCHANGER COMPRISED OF SECTIONS DETACHABLY AND SEALABLY CLAMPED TOGETHER AND ITS METHOD OF ASSEMBLY

FIELD OF THE INVENTION

The invention relates to a heat exchanger having two substantially parallel manifold ducts to which are connected a plurality of heat exchange tubes arranged in bundles axially of the ducts The invention further relates to a method of assembly of such heat exchanger.

BACKGROUND

Heat exchangers of the above type are particularly suitable for operating with gases at high gas temperatures and under rapidly changing thermal conditions. Heretofore, these heat exchanger have been made by rigidly connecting the heat exchange tubes to the manifold ducts by soldering or welding. It is also known to form the ducts of at least two half-shells which are assembled to each other. Alternatively, the ducts can also consist of individual shorter duct sections which are arranged one after the other and soldered together.

Rigid attachment of the parts by soldering or welding has heretofore been considered necessary in order to prevent leakage, during operation, between the heat-exchanging fluids. This is a real problem due to application of considerable thermal stresses, particularly during nonstationary operation and because of external vibrations and vibrations caused by the flow of gas.

This construction has the disadvantage that, in the case of leaks, which can occur either due to defective manufacture or by fatigue of the material, expensive repairs or even replacement of the entire heat exchanger is frequently necessary. Upon application of impact loads transverse to the axis of the manifold duct, high stress peaks can occur at the points of connection between the ducts and the heat exchange tubes due to transient forces, resulting in the danger of cracks and therefore leaks since the ducts are connected to a large number of heat exchange tubes. As a consequence of cracks, there is a local weakening of the rigidity and strength of the ducts, as a result of which there is brought about a progressive increase in the local stress peaks and thus progressive damage until breakage occurs This is particularly critical in the case of application of impact forces on the ducts in the direction of the axes of the heat exchange tubes, since the region of the periphery of the duct at which the U-shaped tubes are connected is the region of the highest tensile and compressive stresses. In this case, therefore, due to the low moment of resistance of the ducts, rapid progressive damage takes place upon alternating or impact loading. The supporting effect produced by bringing the heat exchange tubes together on the one side upon bending of the duct in the direction of the stress plays a minor role here.

SUMMARY OF THE INVENTION

An object of the present invention is to provide an improved heat exchanger of the aforementioned type in which the occurrence of cracks is prevented as a result of lighter loading.

Another object of the invention is to provide an improved heat exchanger which, in the event of cracks, avoids a progressive increase in load. In the case of mechanical impact load, less deformation of the ducts and thus a lower level of stress at the endangered places is obtained.

Another object of the invention is to provide a heat exchanger in which lesser demands are imposed on the quality of the connection between the heat exchange tubes and the ducts which, according to the invention, now have to transmit very reduced mechanical loads, and primarily are required to perform a sealing function. Finally, simplified manufacture, control, inspection and repair of the heat exchanger is made possible.

In accordance with the invention, the above and further objects are obtained by a construction in which each of the ducts comprises a plurality of duct sections arranged axially one after the other in detachable abutting relation and a tension member extends axially of the ducts in spaced relation within the respective duct sections to apply compression to the endmost duct sections to press the duct sections against one another.

By forming each manifold duct from a plurality of duct sections arranged one after the other in detachably clamped relation, it is possible in the event of a leak in the heat exchanger to disassemble the latter and replace the defective section. In this way, a considerably more economical manufacture and maintenance of the heat exchanger is possible. Furthermore, due to the presence of the tension members, the ducts are advantageously given great flexural ridigity, as a result of which the probability of cracks due to impact loads is reduced. Namely, the duct sections are pre-stressed in compression while the tension members are pre-stressed in tension to oppose flexural deformation of the ducts. Furthermore, the inspection of individual heat exchanger sections is considerably simpler than the inspection of a complete heat exchanger.

By virtue of the tension members which are arranged concentrically within the ducts, a reinforcement of the heat exchanger is obtained and impact and bending forces which act on the duct are resisted by the tension members so that the ducts only have to resist the inertial forces of the heat exchanger tubes. In this way, the danger of the formation of cracks is considerably reduced.

By resisting the flexural loading which is produced in the ducts due to application of impact forces in the direction of the heat exchange tubes, the bending of the ducts and thus the magnitude of the stresses in the walls of the ducts, particularly at the regions at which the heat exchange tubes are connected, are pre-established by the tension members and maintained at a low level.

If incipient cracks should occur due to locally high thermal or mechanical loads, particularly in the region of the connection of the heat exchange tubes, the entire system is not damaged thereby since, according to the construction of the invention, local stresses are reduced by the incipient cracks so that a certain stabilizing effect is obtained.

This furthermore has the advantages that with a predetermined local load which is not further increased upon development of incipient cracks in the critical region of the ducts, a substantial increase in the life of the ducts under mechanical and thermal loads is achieved. At the same time, there is the advantage that the connection between the ducts and the heat exchange tubes, which is preferably effected by soldering, no longer needs to have the same high-quality and resulting strength as compared to the conventional construction in which the ducts must resist the entire flexural stressing.

The tension members are preferably constructed as tubes with a plurality of apertures distributed over their surfaces so that the fluid flowing through the ducts can travel without hindrance between the ducts and the heat exchange tubes. In this regard, the wall thickness of the tension tubes is sufficient to provide the required rigidity or strength in all directions of impact.

As an advantageous feature, upon the operation of the heat exchanger, the ducts are under increased axial compressive pre-stress, as a result of which the danger of incipient cracks or leaks is further reduced. For this purpose, the tension tubes preferably have a lower coefficient of thermal expansion than the ducts. This effect is further enhanced since the ducts heat up more than the tension tubes contained therein.

The clamping effect obtained by the tension tubes should be so adjusted that during stationary operation, sufficiently high compressive forces act on the end surfaces of the endmost duct sections and, under nonstationary conditions the tensile loads on the tension tubes remain within the range of elastic elongation.

In a preferred further development of this embodiment of the invention, a shielding plate is mounted on the outer wall of that duct facing the flowing heating gases. Thereby, the temperature of this duct, both in stationary and nonstationary operations, remains uniform along its periphery, as a result of which the longitudinal load on the duct is reduced.

BRIEF DESCRIPTION OF THE FIGURES OF THE DRAWING

The invention will be described hereafter with reference to the accompanying drawing in which:

FIGS. 4*a* and 4*b* are sectional views of end portions of the heat exchanger.

DETAILED DESCRIPTION OF A PREFERRED EMBODIMENT

Figure 1:
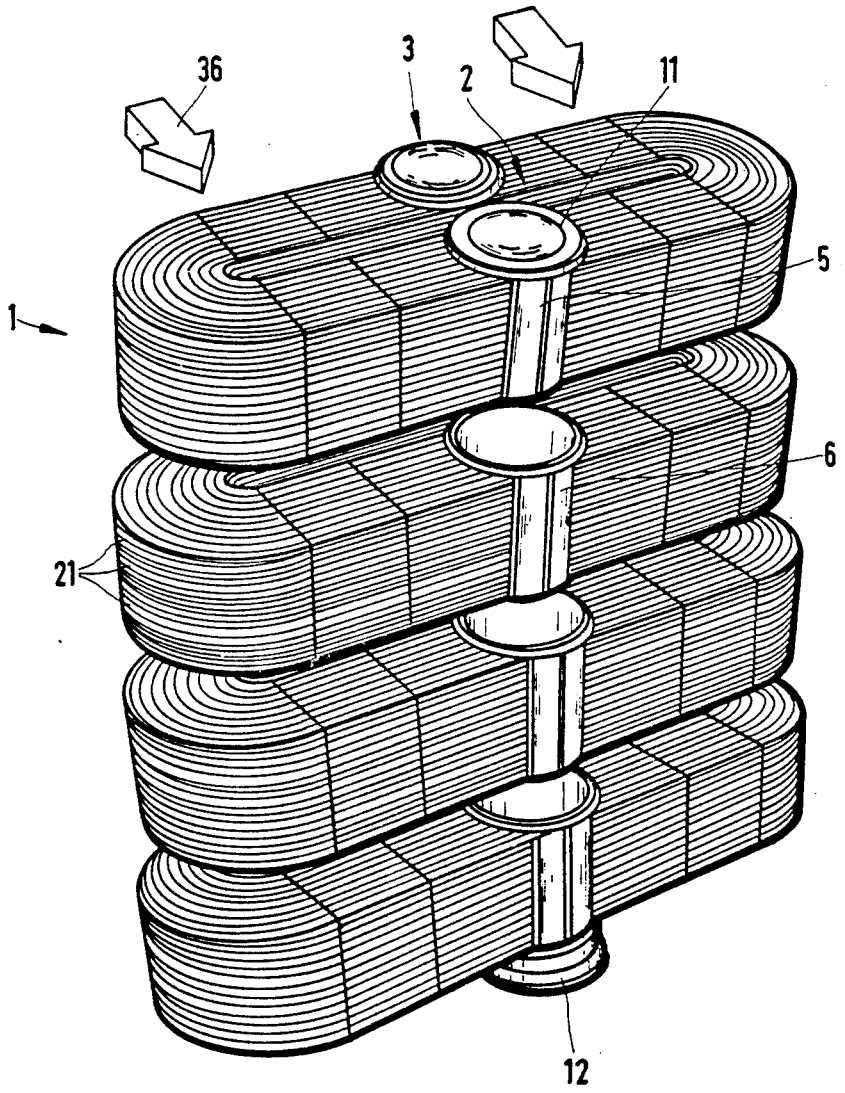
FIG. 1 is a perspective view of a disassembled heat exchanger according to the invention.

FIG. 1 shows a disassembled heat exchanger 1 having manifold ducts 2, 3 respectively comprising a plurality of duct sections 5, 6 arranged axially one after the other. The duct sections 5, 6 are connected together by a plurality of heat exchange tubes 21 of U-shape. The operation of the heat exchanger is as follows. A stream of cool gas axially enters the duct 2. The stream of gas flows through the plurality of heat exchange tubes 21 to duct 3. The gas is heated in the heat exchange tubes 21 by hot gases flowing outside the tubes in the direction of arrows 36. The heated gases in tubes 21 are combined in duct 3 and flow axially through the duct 3 for external discharge to a suitable utilization means (not shown).

At one end, the duct 2 has an end section 12 through which the incoming stream of cool gas is fed. At the opposite end of the duct 2, a closed end section 11 is provided, The heat exchange tubes 21 are secured to the wall of the duct 2 by soldering or welding. Intermediate plates 37 (FIG. 2) are clamped between the individual duct sections 5, 6 and extend between adjoining bundles of heat exchange tubes 21 of the adjacent sections.

Within the duct 2 there is arranged a tension member 15 in the form of a pipe or tube 15 which, at the joints 4 of adjoining duct sections is fitted against the duct 2. The tension pipe 15 is connected at regions 7, 8 to the end sections 11, 12, by threaded connections which permit tension to be applied to pipe 15 and compression to the duct sections. The construction of the threaded connections will be discussed later with reference to FIGS. 4*a* and 4*b*. In the regions of the tension pipe 15 opposite the heat exchange tubes 21, the tension pipe 15 is provided with a plurality of apertures 18 which may be regularly distributed over its circumference. This permits the flow of gas between the inside of the tension pipe 15 and the heat exchange tubes 21. At the end sections 11 and 12, end plates 38 are secured parallel to the intermediate plates 37. The construction of duct 2 and tension pipe 15, shown in FIG. 2 and described above, is effected in analogous manner in the duct 3 and tension pipe 16.

Figure 2:
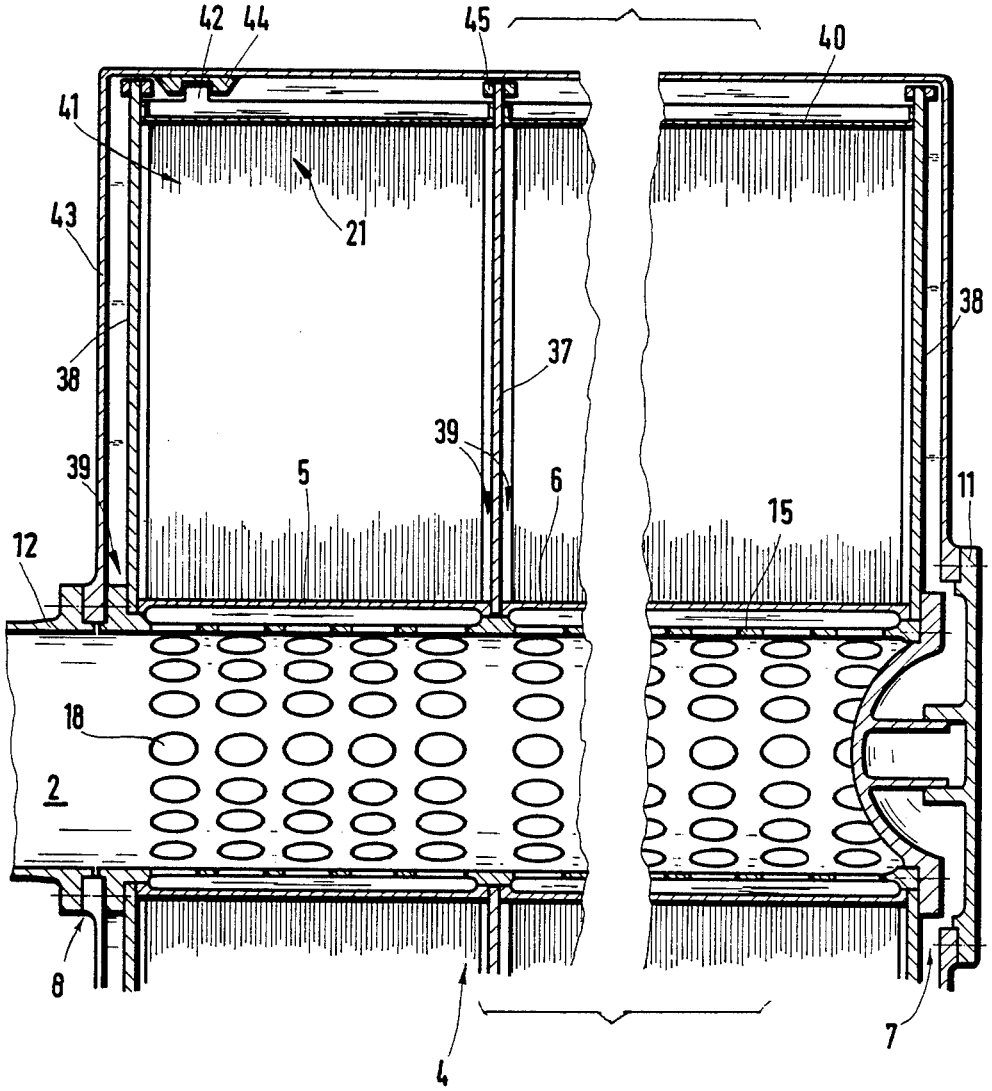
FIG. 2 is an axial section, broken in length, through a manifold duct of the heat exchanger in FIG. 1 after assembly thereof.

The intermediate plates 37 and the end plates 38 are so formed that narrow gaps 39 are provided without heat exchange tubes 21 for reasons of strength. The intermediate plates 37 arranged between adjoining duct sections 5, 6, as well as the end plates 38 as shown in FIG. 2 and described above, is effected in analogous manner in the duct 3 and tension pipe 16.

The intermediate plates 37 arranged between adjoining duct sections 5, 6, as well as the end plates 38 are connected together by end plates 40 at the arcuate bends 41 of the heat exchange tubes. The end plates 40 also serve for the guidance of the external hot gases. Furthermore, the intermediate plates 37 and end plates 38, together with the end plates 40, prevent deflection or deformation of the heat exchange tubes upon application of impact forces in the axial direction of the ducts such that the deflection of the arcuate bends 41 in the axial direction of the duct is avoided in entirety. For this purpose, there is arranged on one of the end plates 40 a nose 42 which is held in a given position by a counter piece 44 which is fastened to a surrounding housing 43 of the heat exchanger 1. In this way, the part of the heat exchanger which is normally subject to deformation upon application of impact forces in the axial direction of the duct, i.e., the assembly of all heat exchange tubes 21, intermediate plates 37 and end plates 38, is securely held fast.

Figure 3:
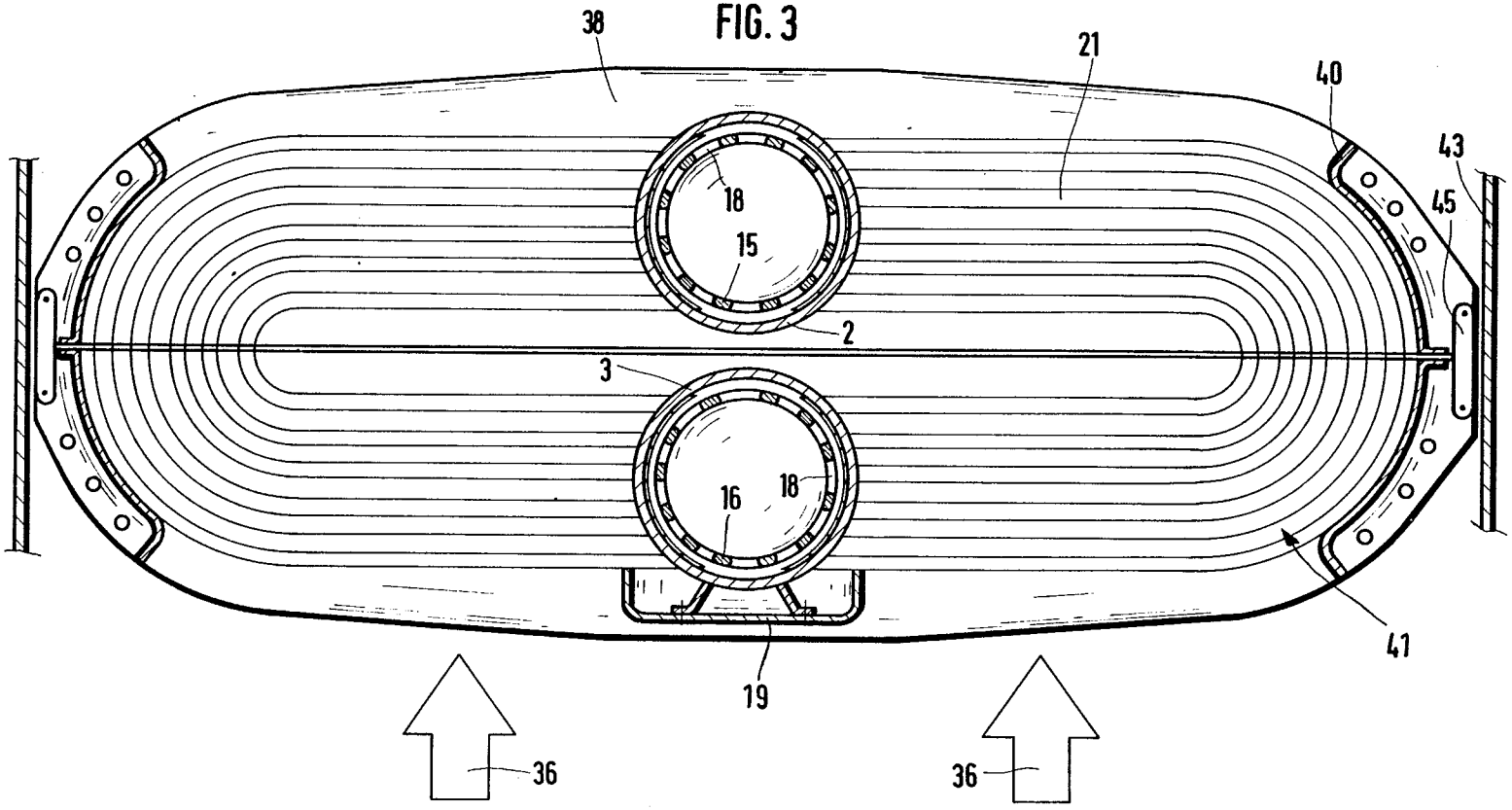
FIG. 3 is a transverse cross-sectional view through the heat exchanger.

The intermediate plates 37 and end plates 38, as shown in FIG. 3, are divided into two parts along the axis of the heat exchange tubes to equalize the differential thermal expansion of the upper and lower sides of the heat exchanger 1 and thus of the intermediate and end plates 37, 38 as a result of the temperature gradient in the direction of the incoming gas flow 36. The end plates 40 are also constructed in two parts and they are bolted to the intermediate and end plates 37, 38. The two parts of the end plates 40 are connected by links 45 so that the gap between the two parts remains constant with respect to the required seal under all thermal conditions.

At the side of duct 3 at which hot gases enter the heat exchanger, a shielding plate 19 is positioned so that the hot stream of gases is blocked from directly contacting the duct 3 and the connections between duct 3 and the heat exchange tubes 21. In this way, the temperature gradients on the circumference of the duct 3 are considerably reduced.

The end sections 11, 12 additionally serve for the centering of the ducts 2, 3 and are so constructed that the heat exchanger 1 can expand freely in the axial direction of the ducts. This is obtained as seen in FIG. 2 by a sliding connection 46 in end section 11.

FIG. 4*a* shows the details of the attachments at the upper end of the heat exchanger to end section 11 and FIG. 4*b* shows the details of the attachments at the lower end of the heat exchanger to end section 12. Tension pipe 15 is connected at its upper end to end section 11 by a number of equally angularly spaced bolts 22 which are threadably engaged in pipe 15 and rotatable in end section 11. A clearance space 23 is formed between the upper end of pipe 15 and the end section 11. At its lower end, the pipe 15 is connected by bolts 24 to end section 12. The bolts 24 are threadably engaged in pipe 15 and rotatable in end section 12. By turning bolts 22 and 24, tension can be applied to pipe 15 while the duct sections 5, 6 are pressed together by the forces applied by the bolts to the endmost duct sections. In use, the main tension stress is achieved by the difference in thermal expansion between the relatively hot duct sections 5,6 compared to the relatively cool pipe 15.

Although the invention has been disclosed in relation to a specific embodiment thereof, it will become apparent to those skilled in the art that numerous modifications and variations can be made within the scope and spirit of the invention as defined in the attached claims.

What is claimed is:

1. A heat exchanger comprising two substantially parallel manifold ducts and a plurality of heat exchange tubes connected to said ducts and arranged in bundles extending axially of the ducts, each of said ducts comprising a plurality of duct sections arranged axially one after the other in detachable abutting relation and a tension member extending axially of the ducts in spaced relation within the respective duct sections and applying compression to the endmost duct sections to press the duct sections against one another, said tension member having a smaller coefficient of thermal expansion than said ducts.

2. A heat exchanger as claimed in claim 1 wherein said tension member comprises a tubular member.

3. A heat exchanger as claimed in claim 2 wherein said tubular member is provided with a plurality of apertures distributed therein.

4. A heat exchanger as claimed in claim 2 wherein said tubular member extends substantially centrally within said duct sections.

5. A heat exchanger as claimed in claim 1 comprising a shielding plate on one of said ducts for blocking incoming hot gases from contacting said one duct.

6. A heat exchanger as claimed in claim 1 comprising intermediate plates mounted on said ducts between adjoining duct sections.

7. A heat exchanger as claimed in claim 6 wherein said intermediate plates extend between adjacent bundles of heat exchange tubes.

8. A heat exchanger as claimed in claim 1 comprising means connected to said tension member for applying tension thereto and compressive forces to said endmost duct sections.

9. A method of assembling a heat exchanger comprising arranging in axial succession a plurality of sections each including a pair of parallel manifold duct elements connected by a plurality of heat exchange tubes, pressing the manifold duct elements of the adjoining sections together in detachable sealed relation by applying compressive forces to the endmost duct elements by a tension member extending axially of the duct elements in spaced relation therewith and clamping between adjoining duct elements an intermediate plate which extends between the heat exchange tubes of the adjoining sections.

10. A method as claimed in claim 9 comprising forming the tension member as a perforate hollow tube for conveying fluid between the interior of the tube and the surrounding duct elements.

11. A heat exchanger comprising two substantially parallel manifold ducts and a plurality of heat exchange tubes connected to said ducts and arranged in bundles extending axially of the ducts, each of said ducts comprising a plurality of duct sections arranged axially one after the other in detachable abutting relation, a tension member extending axially of the ducts in spaced relation within the respective duct sections and applying compression to the endmost duct sections to press the duct section against one another and intermediate plates mounted on said ducts between adjoining duct sections.

12. A heat exchanger as claimed in claim 11 wherein said intermediate plates extend between adjacent bundles of heat exchange tubes.

* * * * *